US008156591B2

(12) United States Patent
Lee et al.

(10) Patent No.: US 8,156,591 B2
(45) Date of Patent: Apr. 17, 2012

(54) WASHING MACHINE AND OPERATING METHOD THEREOF

(75) Inventors: Soon Jo Lee, Changwon-si (KR); Ho Cheol Kwon, Changwon-si (KR); Beom Jun Kim, Changwon-si (KR); Hyun Soo Kim, Changwon-si (KR); Hack Chai Song, Changwon-si (KR); Kwang Young Lee, Changwon-si (KR); Eun Suk Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 571 days.

(21) Appl. No.: 11/828,008

(22) Filed: Jul. 25, 2007

(65) Prior Publication Data

US 2008/0028540 A1 Feb. 7, 2008

(30) Foreign Application Priority Data

Jul. 27, 2006 (KR) ..... 10-2006-0070799

(51) Int. Cl.
*D06F 35/00* (2006.01)
*D06F 39/00* (2006.01)

(52) U.S. Cl. ..... 8/158; 8/159

(58) Field of Classification Search ..... 8/158–159
See application file for complete search history.

(56) References Cited

U.S. PATENT DOCUMENTS

2004/0154350 A1* 8/2004 Weinmann ..... 68/12.04

FOREIGN PATENT DOCUMENTS

CN 1888219 A 1/2007
WO WO 2005/106096 A1 11/2005

OTHER PUBLICATIONS

Chinese Office Action dated Jul. 10, 2009.
German Office Action dated Sep. 18, 2008.

* cited by examiner

*Primary Examiner* — Michael Barr
*Assistant Examiner* — Jason Ko
(74) *Attorney, Agent, or Firm* — KED & Associates LLP

(57) ABSTRACT

A washing machine and an operating method of the washing machine are provided. In the operating method of the washing machine, it is determined whether a washing machine has a regular laundry load or a single laundry load based on the amount of laundry and the number of times of detection of the amount of laundry. Therefore, it is possible to precisely determine the laundry load of a washing machine, reduce the time taken to determine the laundry load of a washing machine, and prevent a washing machine from being damaged by a misreading of the laundry load of a washing machine.

2 Claims, 5 Drawing Sheets

WASHING MACHINE AND OPERATING METHOD THEREOF

This application claims priority from Korean Patent Application No. 10-2006-0070799 filed on Jul. 27, 2006 in the Korean Intellectual Property Office, the disclosure of which is incorporated herein by reference in its entirety.

BACKGROUND OF THE INVENTION

1. Field of the Invention

The present invention relates to a washing machine and an operating method thereof, and more particularly, to a washing machine and an operating method thereof in which it is determined whether a washing machine has a single laundry load or no laundry load at all based on the amount of laundry in a drum and the number of times of detection of the amount of laundry in the drum.

2. Description of the Related Art

In general, washing machines are devices for cleaning laundry by supplying wash water so that the laundry can be soaked, dissolving a detergent into the wash water, and removing dust and dirt from the laundry. More specifically, washing machines rotate a drum including laundry so that mechanical friction or vibration between wash water and the laundry can be caused, and that dust and dirt can be easily removed from the laundry.

Washing machines remove dust and dirt from laundry by performing washing, rinsing, and water discharge operations according to wash settings input thereto. In particular, washing machines perform a water discharge operation by rotating a drum at high speed. During a water discharge operation, laundry may be entangled. Then, the eccentricity of laundry may increase considerably, and thus, a washing machine may be damaged. Therefore, it is necessary to determine the laundry load of a washing machine before a water discharge operation.

However, there is always a probability of mistakenly determining that a washing machine has a single laundry load, a regular laundry load, or no laundry load at all, and a mistaken reading of the laundry load of a washing machine is highly likely to result in damage to a washing machine. Also, conventional washing machines perform laundry amount detection and laundry eccentricity detection more than a predefined number of times, thereby increasing the time taken to determine laundry load and resulting in a prolonged washing time.

SUMMARY OF THE INVENTION

The present invention provides a washing machine and an operating method thereof in which the precision of determination of the laundry load of a washing machine can be improved by determining whether the washing machine has a single laundry load or no laundry load at all based on the amount of laundry in a drum and the number of times of detection of the amount of laundry in the drum.

According to an aspect of the present invention, there is provided a washing machine including a laundry amount detection unit which detects an amount of laundry; a laundry eccentricity detection unit which detects an eccentricity of laundry; a load determination unit which determines whether the washing machine has a single laundry load based on the detected laundry amount and the detected laundry eccentricity; and a control unit which varies wash settings regarding a washing operation according to the result of the determination performed by the load determination unit.

According to another aspect of the present invention, there is provided an operating method of a washing machine, the operating method including detecting an amount of laundry; if the detected laundry amount is less than a reference laundry amount, repeatedly detecting the amount of laundry a predefined number of times; and if the repeatedly detected laundry amounts are all less than the reference laundry amount, performing a washing operation corresponding to a single laundry load condition.

According to another aspect of the present invention, there is provided an operating method of a washing machine, the operating method including detecting an amount of laundry; if the detected laundry amount is less than a reference laundry amount, repeatedly detecting the amount of laundry a predefined number of times; and if the repeatedly detected laundry amounts are all less than the reference laundry amount, performing a water discharge operation using a laundry eccentricity corresponding to a single laundry load condition.

According to another aspect of the present invention, there is provided an operating method of a washing machine, the operating method including detecting an amount and an eccentricity of laundry; if the detected laundry amount is less than a reference laundry amount and the detected laundry eccentricity is less than a reference laundry eccentricity, repeatedly detecting the amount and the eccentricity of laundry a predefined number of times; and if the repeatedly detected laundry amounts are all less than the reference laundry amount and the repeatedly detected laundry eccentricities are all less than the reference laundry eccentricity, performing a water discharge operation using a laundry eccentricity corresponding to a minimum laundry load condition or a no-laundry load condition.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

The present invention will hereinafter be described in detail with reference to the accompanying drawings in which exemplary embodiments of the invention are shown.

Figure 1:
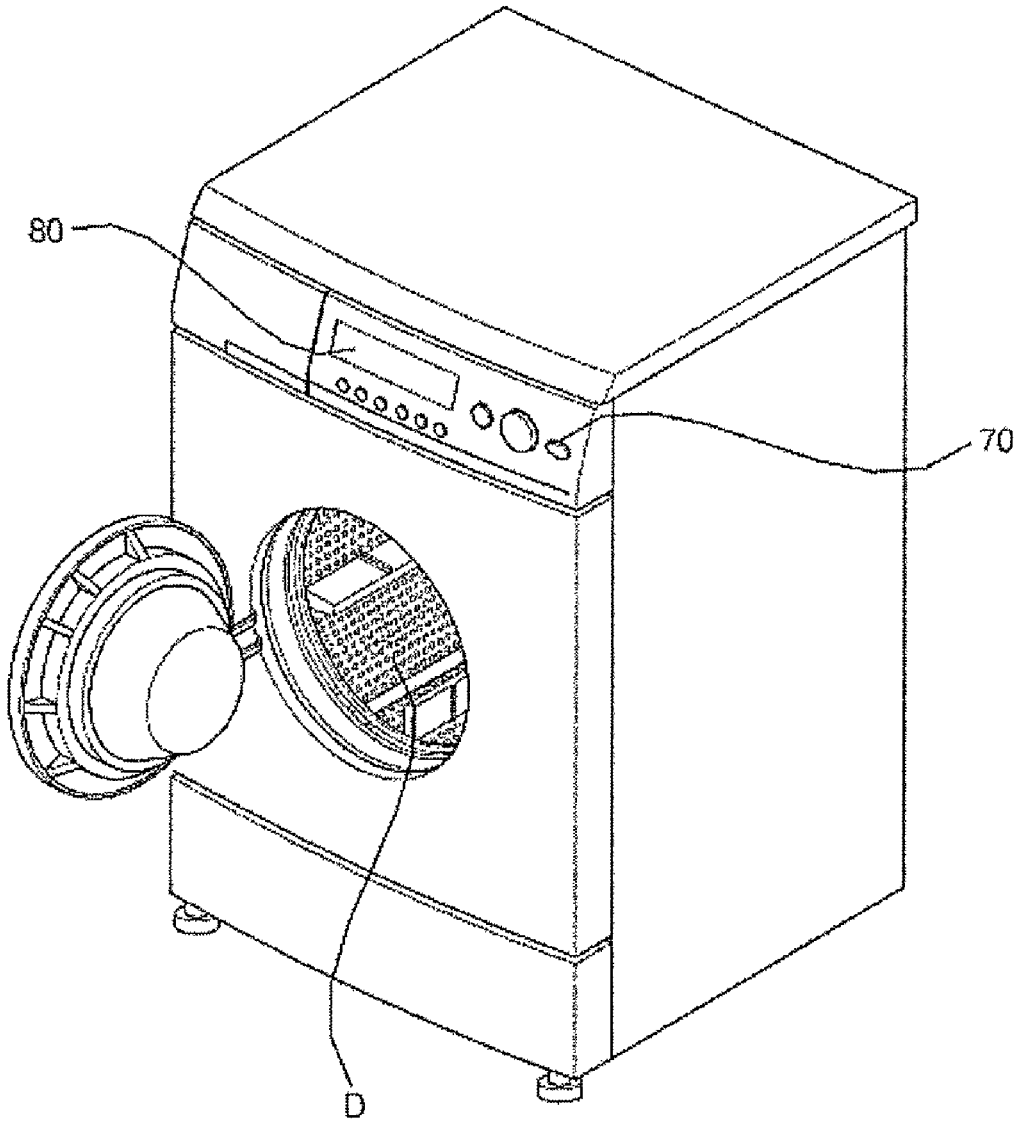
FIG. 1 is a perspective view of a washing machine according to an embodiment of the present invention.
Figure 2:
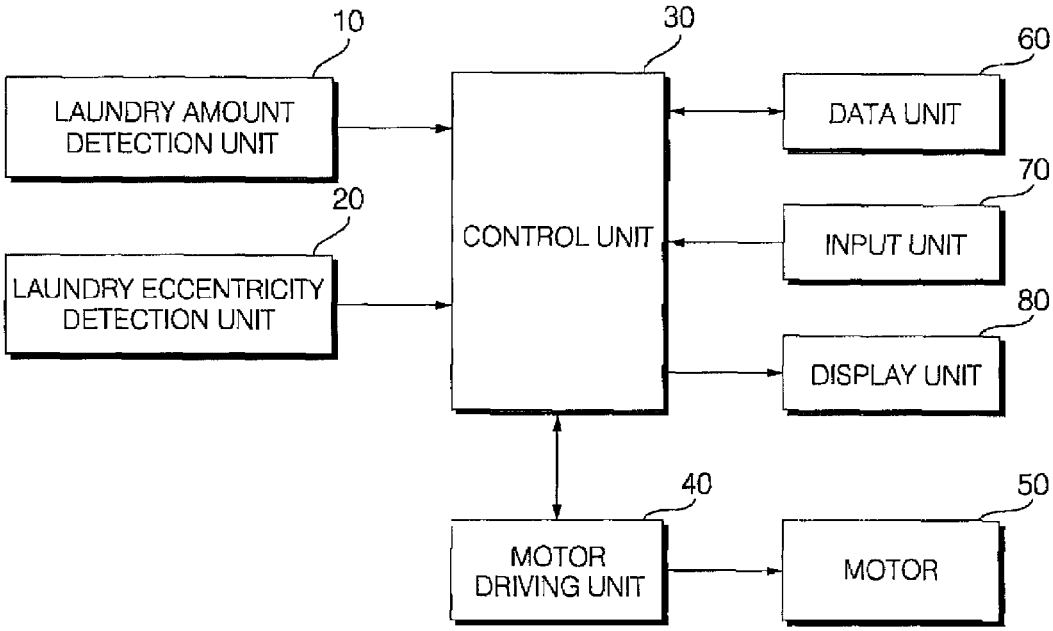
FIG. 2 is a block diagram of the washing machine illustrated in FIG. 1.

FIG. 1 is a perspective view of a washing machine according to an embodiment of the present invention, and FIG. 2 is a block diagram of the washing machine illustrated in FIG. 1. Referring to FIGS. 1 and 2, the washing machine includes a motor 50 which rotates a drum D, a motor driving unit which drives the motor 50, a laundry amount detection unit 10 which detects the amount of laundry in the drum D, and a laundry eccentricity detection unit 20 which detects the eccentricity of the laundry in the drum D. The eccentricity of laundry indicates how much the laundry in the drum D is entangled and inclined to one side.

The washing machine also includes an input unit 70 which receives various commands for setting an operation of the washing machine from a user, a data unit 60 which stores control data necessary for an operation of the washing machine and various wash settings, a display unit 80 which displays information regarding an operating state of the washing machine, and a control unit 30 which controls an operation of the washing machine according to wash settings and determines the laundry load of the washing machine based on a laundry amount detected by the laundry amount detection unit 10 and a laundry eccentricity detected by the laundry eccentricity detection unit 20. The control unit 30 generates a motor driving signal based on data input thereto so that the drum D can be rotated in a predefined manner.

The laundry amount detection unit 10 detects the amount of laundry in the drum D by rotating the drum at low speed and then measuring the time taken for the drum D to reach a predefined rotation speed and the time taken for the drum D to stop rotating after the motor 50 stops driving. The laundry amount detection unit 10 may detect the amount of laundry in the drum D by rotating the drum D at 80 revolutions-per-minute (RPM).

The laundry eccentricity detection unit 20 rotates the drum D at a uniform speed and then detects, as an eccentricity value, a ripple value when the number of revolutions of the motor 50 is uniformly maintained.

If the laundry amount detected by the laundry amount detection unit 10 is greater than a reference laundry amount, the control unit 30 determines that the washing machine has a regular laundry load and controls washing, rinsing, and water discharge operations corresponding to the regular laundry load to be performed. The reference laundry amount corresponds to a laundry amount set for a small amount of laundry, and may be varied according to the type of washing machine and wash settings.

If the laundry amount detected by the laundry amount detection unit 10 is less than the reference laundry amount, the control unit 30 controls the laundry amount detection unit 10 to perform a laundry amount detection operation a predefined number of times or more. If a laundry amount less than the reference laundry amount is detected more a predetermined number of times in series, the control unit 30 determines that the washing machine has a single laundry load, and controls washing, rinsing, and water discharge operations corresponding to the single laundry load to be performed.

The control unit 30 may also determine whether the washing machine has no laundry load based on the laundry amount detected by the laundry amount detection unit 10 and the laundry eccentricity detected by the laundry eccentricity detection unit 20.

If a laundry amount less than the reference laundry amount is repeatedly detected more than a predefined number of times in series and the laundry eccentricity detected by the laundry eccentricity detection unit 20 is less than a reference laundry eccentricity, the control unit 30 determines that the washing machine has no laundry load or a minimum laundry load.

The control unit 30 sets the number of revolutions of the motor 50 for each operation set by the input unit 70, generates a control command corresponding to each operation set by the input unit 70, and applies the control command to the motor driving unit 40. Also, the control unit 30 controls information regarding an operating state of the washing machine to be displayed by the display unit 80 so that the user can easily recognize the progress of a washing machine performed by the washing machine.

An operation of the washing machine illustrated in FIGS. 1 and 2 will hereinafter be described in detail.

Figure 3:
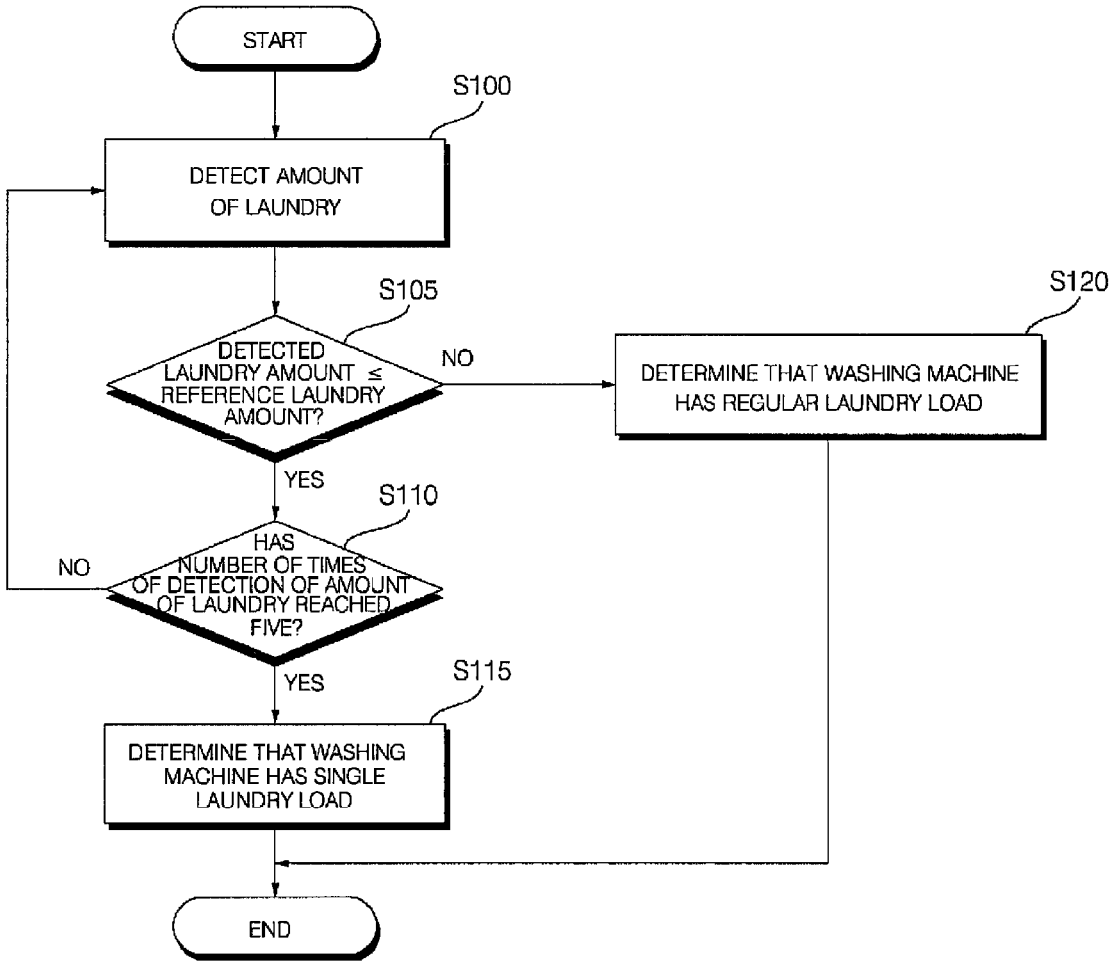
FIG. 3 is a flowchart illustrating the determination of whether a washing machine has a single laundry load, according to an embodiment of the present invention.

FIG. 3 is a flowchart illustrating the determination of whether a washing machine has a single laundry load, according to an embodiment of the present invention. Referring to FIG. 3, the amount of laundry in a drum is detected at a predetermined RPM (S100). The detected laundry amount is compared with a reference laundry amount (S105). If the detected laundry amount is greater than the reference laundry amount, a washing machine is set to a regular laundry load mode (S120).

The predetermined RPM may be about 80 RPM, but the present invention is not restricted to this. In other words, the predetermined RPM may be varied according to the type of washing machine and wash settings. Also, the reference laundry amount is simply a reference value for determining whether a washing machine has a small laundry load, and may thus be varied.

Once the washing machine is set to the regular laundry load mode, a washing operation corresponding to the regular laundry load mode is performed according to wash settings (i.e., the number of revolutions of the drum, a reference laundry amount and a reference laundry eccentricity) corresponding to the regular laundry load mode.

If the detected laundry amount is less than the reference laundry amount, it is determined whether the detection of the amount of laundry has been performed at least a predetermined number of times (S110). The predetermined number may be five, but may be varied according to wash settings.

If the detected laundry amount is less than the reference laundry amount and the detection of the amount of laundry has been performed less than five times, the detection of the amount of laundry is performed a number of times in series. If a laundry amount less than the reference laundry amount is detected five times or more in series, the washing machine is set to a single laundry load mode (S115).

Figure 4:
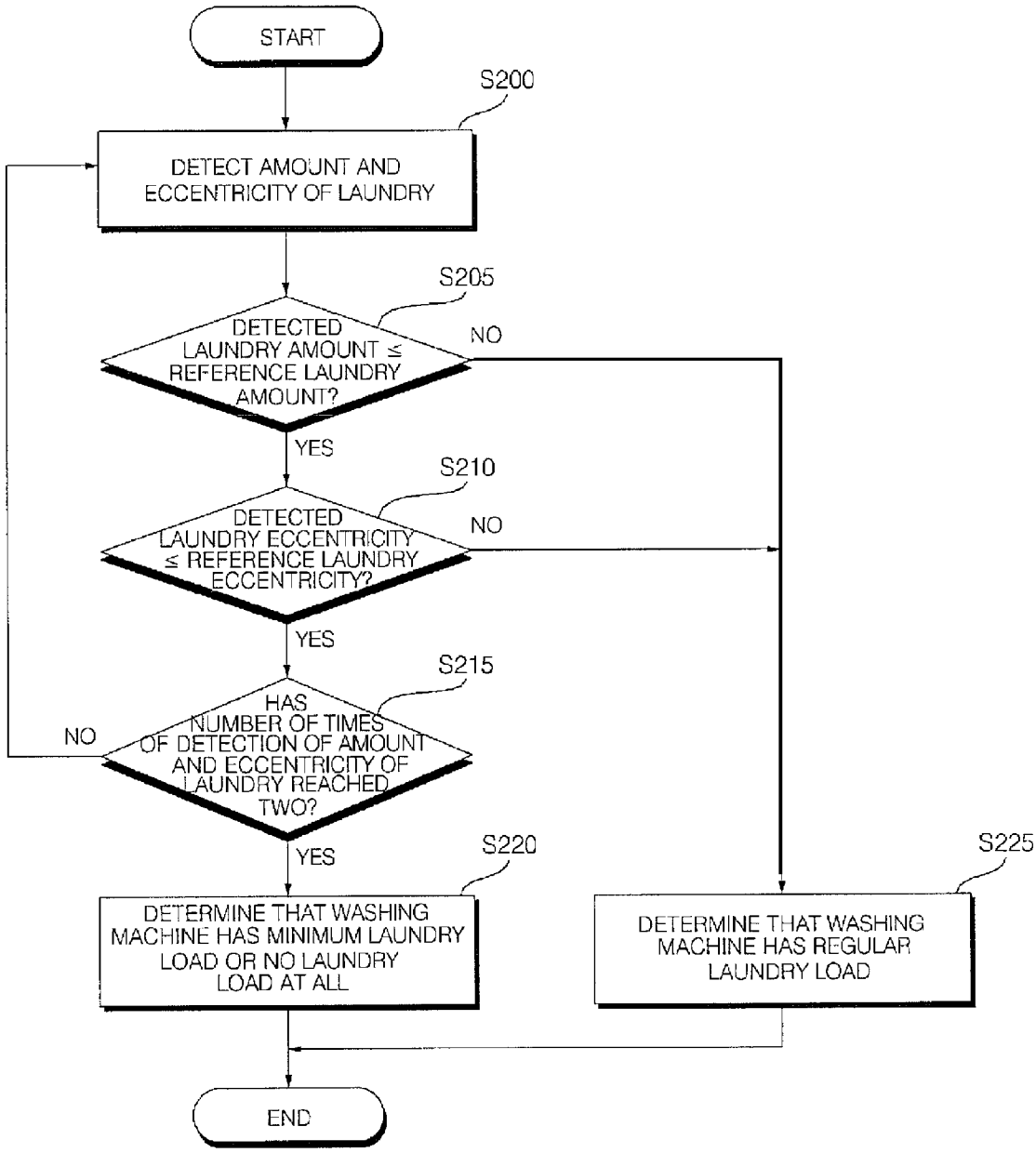
FIG. 4 is a flowchart illustrating the determination of whether a washing machine has no laundry load, according to an embodiment of the present invention.

FIG. 4 is a flowchart illustrating the determination of whether a washing machine has a minimum laundry load or no laundry load at all, according to an embodiment of the present invention. Referring to FIG. 4, the amount and the eccentricity of laundry in a drum are detected at a predetermined RPM (S200). The predetermined RPM may be 80 RPM.

The eccentricity of laundry in the drum may be measured on left and right sides of the drum during a lateral agitation operation.

The detected laundry amount is compared with a reference laundry amount (S205). If the detected laundry amount is greater than the reference laundry amount, it is determined that a washing machine has a regular laundry load, and thus a washing operation corresponding to the regular laundry load is performed (S225).

On the other hand, if the detected laundry amount is less than the reference laundry amount, the detected laundry eccentricity is compared with a reference laundry eccentricity (S210). If the detected laundry eccentricity is less than the reference laundry eccentricity, it is determined whether the detection of the amount and the eccentricity of laundry has been performed more than a predetermined number of times, for example, more than two times (S215). If the detection of the amount and the eccentricity of laundry has been performed less than two times, the method returns to operation S200.

If the detected laundry amount is less than the reference laundry amount, the detected laundry eccentricity is less than the reference laundry eccentricity, and the detection of the amount and the eccentricity of laundry has been performed two times or more, it is determined that the washing machine has a minimum laundry load or no laundry load at all (S220).

If the detected laundry amount is less than the reference laundry amount and the detected laundry eccentricity is greater than the reference laundry eccentricity or if the detected laundry amount is greater than the reference laundry amount, it is determined that the washing machine has the regular laundry load (S225).

In the embodiment of FIG. 4, like in the embodiment of FIG. 3, if a laundry amount less than the reference laundry amount is repeatedly detected more than a predefined number of times, it may be determined whether the washing machine has a single laundry load.

Figure 5:
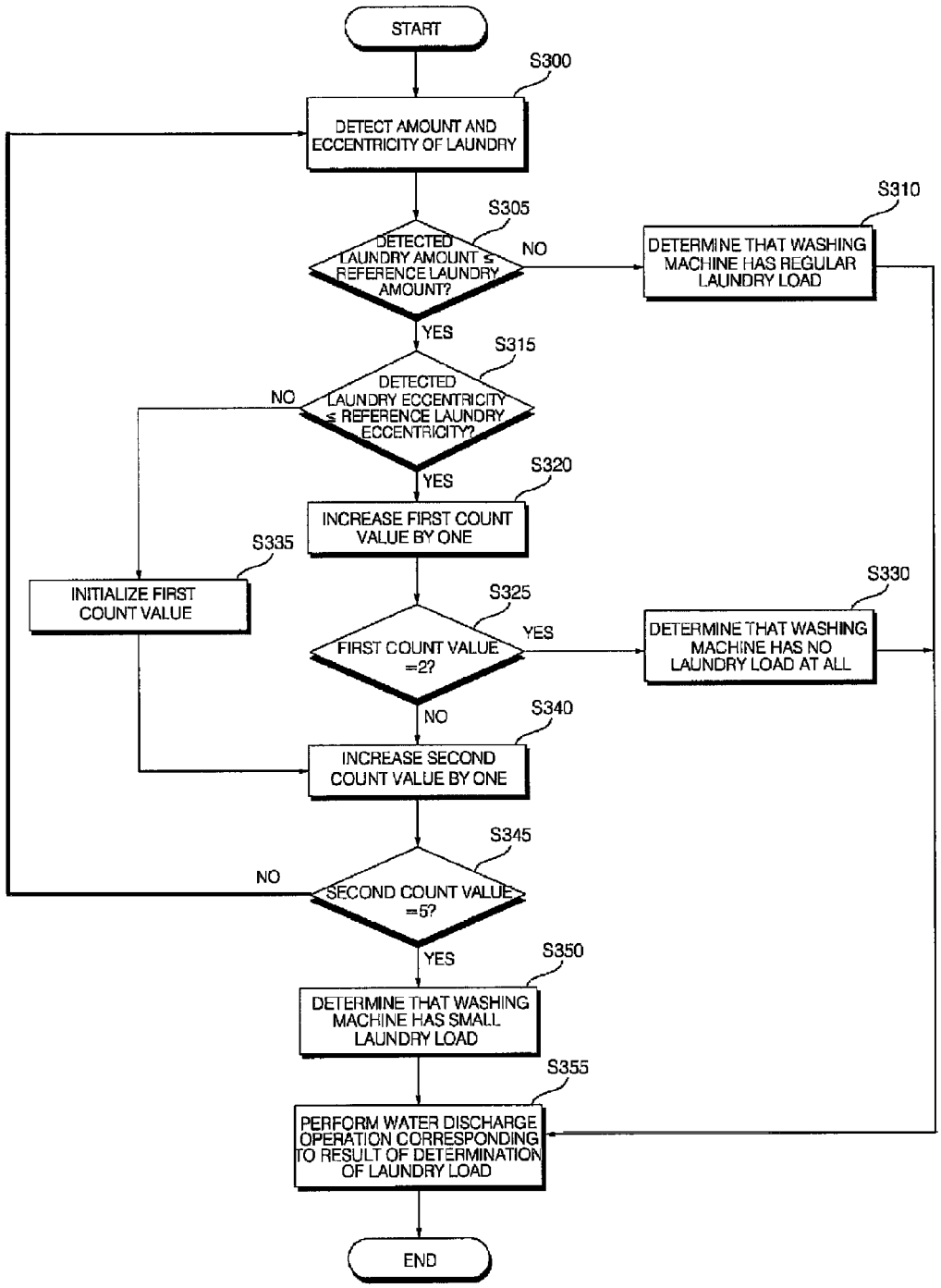
FIG. 5 is a flowchart illustrating an operating method of a washing machine, according to an embodiment of the present invention.

FIG. 5 is a flowchart illustrating an operating method of a washing machine, according to an embodiment of the present invention. Referring to FIG. 5, the amount and the eccentricity of laundry in a drum are detected at a predetermined RPM (S300). The predetermined RPM may be 80 RPM.

It is determined whether the detected laundry amount is greater than a reference laundry amount (S305) by comparing the detected laundry amount with the reference laundry amount. If the detected laundry amount is greater than the reference laundry amount, it is determined that a washing machine has a regular laundry load (S310).

On the other hand, if the detected laundry amount is less than the reference laundry amount, the detected laundry eccentricity is compared with a reference laundry eccentricity (315). If the detected laundry eccentricity is less than the reference laundry eccentricity, a first count value is increased by 1 (S320). If the first count value is 2 or greater (S325), it is determined that the washing machine has a minimum laundry load or no laundry load at all (S330).

If the detected laundry eccentricity is greater than the reference laundry eccentricity, the first count value is initialized (S335). Thereafter, a second count value is increased by 1 (S340). If the second count value is greater than a predetermined value, it is determined that the washing machine has a small laundry load (S350). On the other hand, if the second count value is less than the predetermined value, the method returns to operation S300.

An operation of the washing machine is performed (S355) according to the result of the determination of the laundry load of the washing machine, i.e., the result of operation S310, S330, or S355.

As described above, according to the present invention, it is determined whether a washing machine has a minimum laundry load, a single laundry load, a regular laundry load, or no laundry load at all based on the number of times of detection of the amount and the eccentricity of laundry in a drum. Thus, it is possible to reduce the time taken to determine the laundry load of a washing machine and prevent a washing machine from being damaged by a misreading of the laundry load of the washing machine.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An operating method of a washing machine comprising:

detecting an amount of laundry and an eccentricity of laundry;

if the detected laundry amount is less than a reference laundry amount and the detected eccentricity of laundry is less than a reference laundry eccentricity, detecting the amount of laundry and the eccentricity a predetermined number of additional times; and if the additional detected laundry amounts are all less than the reference laundry amount and the additional detected laundry eccentricities are all less than a reference laundry eccentricity; performing an operation corresponding to a predetermined laundry load condition which is less than a full load condition, wherein the predetermined number of additional times is one or more, if at least one of the detected laundry amounts is greater than the reference laundry amount or if an additional detected laundry eccentricity is greater than the reference laundry eccentricity, stopping detecting the amount of laundry or the eccentricity of laundry and performing a washing operation corresponding to a second laundry load condition, wherein the second laundry load condition corresponds to the full load condition, wherein if the detected and additional detected laundry eccentricities are less than the reference laundry eccentricity, then:

determining that the washing machine has no laundry load, and performing a water discharge operation, and wherein if one of the additional detected laundry eccentricities is greater than the reference laundry eccentricity, then:

determining that the washing machine has less than the full load and more than no laundry load, and performing a washing operation based on a pre-stored setting that corresponds to less than the full load but more than no laundry load.

2. The operating method of claim 1, wherein the laundry amounts and the laundry eccentricities are detected a same number of additional times.

* * * * *